United States Patent [19]

Anderton et al.

[11] 4,290,193

[45] Sep. 22, 1981

[54] CONNECTOR EXTRACTOR TOOL

[75] Inventors: John J. Anderton, Oil City; Lynette E. Graham, Titusville, both of Pa.

[73] Assignee: GTE Products Corporation, Stamford, Conn.

[21] Appl. No.: 105,188

[22] Filed: Dec. 19, 1979

[51] Int. Cl.[3] ..... H01R 43/00

[52] U.S. Cl. ..... 29/764; 29/278

[58] Field of Search ..... 29/764, 762, 741, 739, 29/278, 426.6

[56] References Cited

U.S. PATENT DOCUMENTS 3,964,148 6/1976 Sturtevant ..... 29/764

4,155,159 5/1979 Hogan et al. ..... 29/764

*Primary Examiner*—Carl E. Hall

*Attorney, Agent, or Firm*—Robert E. Walter

[57] ABSTRACT

An extractor tool which is suitable for removing a connector of the type having a latch for releasably fastening the connector to a support member includes first and second connector gripping members mounted for movement toward and away from one another in a given direction. The connector gripping members are normally biased in an open position with hand actuated means being provided for moving the gripping members to a clamping position. A latch engaging member is mounted on at least one of the gripping members for movement in a direction substantially normal to the given direction and includes a wedge-shaped end which engages and releases the connector from the support member.

3 Claims, 3 Drawing Figures

CONNECTOR EXTRACTOR TOOL

TECHNICAL FIELD

The present invention relates to an extractor tool for removing electric connectors fastened to a support member.

Connector extractor tools are often used for connectors utilized in the telephone switching field. It is often desirable in telephone switching equipment to provide for electrical interconnection between a cable and a printed circuit board which serves to modify an incoming electrical signal transmitted via the cable. It is also often desirable to transmit the modified signal from the board through other electrical cables. Many such assemblies have been of relatively complex design which require many multiple manual operations in order to satisfactorily provide the desired interconnections. Assembly, repair and disassembly is both time consuming and expensive by manufacturing standards. Rapid interconnection and interchangeability of the various cables being connected to the circuit board is a beneficial feature.

BACKGROUND ART

U.S. Pat. No. 4,047,785 to Jayne describes a connector assembly having a separable cover means which slidably engages an insulative housing to cover the wire in addition to defining an opening for receiving a wire. The contacts positioned within the housing have a slotted end portion for electrically engaging the wire and an opposing end portion for slidably engaging a male pin.

U.S. Pat. No. 4,037,906 to Jayne relates to a connector having an insulating housing and contacts having a contacting portion within the housing and another portion extending outwardly from the housing. A cover is pivotably mounted to the housing for covering a recess area within the housing.

SUMMARY OF THE INVENTION

In accordance with the present invention, there is provided an extractor tool for removing a connector of the type having a latch for releasably fastening the connector to a support member, said tool comprising first and second connector gripping members mounted for movement toward and away from one another in a given direction, means for normally biasing said connector gripping members in an open position, hand actuated means operably associated with said connector gripping members for moving said members to a clamping position against the force of said biasing means, a latch engaging member mounted on at least one of said gripping members for movement in a direction substantially normal to the given direction, said latch engaging member having a wedge shaped end adapted to engage and release said connector from said support member when said gripping members are in a clamping position and said latch engaging member is moved toward said latch.

DETAILED DESCRIPTION

Figure 2:
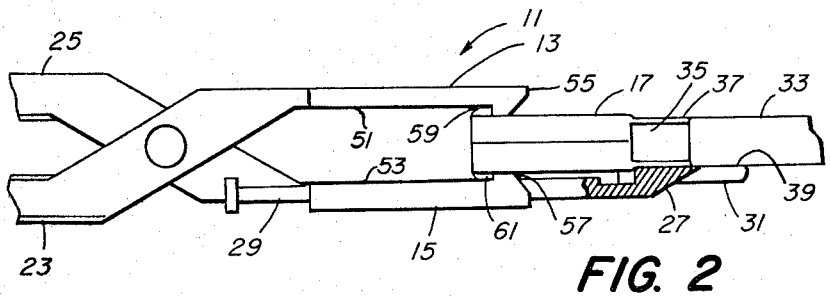
FIG. 2 is a partial side elevational view showing the extractor tool as used in conjunction with a connector and showing a partial section of the connector snap lock portion along 2—2 of FIG. 3.

As illustrated in FIG. 2, the extractor tool generally indicated at 11 comprises a pair of opposing gripping members 13, 15 which engage and clamp the connector 17 therebetween when the handle portions 19, 21 of the pivotably mounted arms 23, 25 are squeezed together. By urging the wedge-shaped end 27 of latch-engaging member 29 into engagement with the latch 31, the connector 17 may be readily unfastened from the mounting member 33. The extractor tool 11 of the present invention is ideally suited for use with connectors as described in applicant's copending U.S. patent applications Ser. No. 081,601, filed Oct. 3, 1979 entitled Cable Connector; Ser. No. 081,606, filed Oct. 3, 1979 entitled Cable Connector; and Ser. No. 081,602, filed Oct. 3, 1979 entitled Circuit Board Connector. FIG. 2 illustrates the interconnection of a cable connector 17 to a mounting member or an edge mounted header 33 providing electrical connection of a cable with the conductive portions or pads on a circuit board. The edge mounted header 33 includes a pluggable portion 35 for receiving the cable connector 17.

The connector 17 includes a flange 37 projecting outwardly in a direction normal to the bottom surface so as to form a receptacle for the pluggable portion 35. The mounting member 33 includes a protrusion 39 for engaging the latch 31. The protrusion 39, which lies along the path of the latch 31, engages the latch 31 for securing the connector 17.

Figure 3:
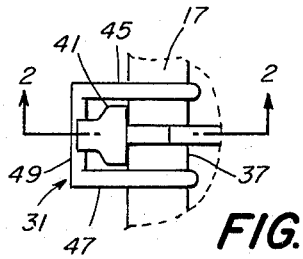
FIG. 3 is a top elevational view of the snap lock portion of the connector.

The snap lock portion 41 of the latch 31 is shown in FIG. 3. The latch 31 is described in detail in the above mentioned copending applications. The following is a general description of the latch 31. The latch 31 comprises a pair of arms or beams 45, 47 in substantially parallel alignment which project outwardly from the flange 37. A bar 49 interconnects the beams 45, 47 spaced from the flange 37. A snap lock portion 41 is connected at one end to the bar 49. Due to the torsional properties of the bar 49, the end of the snap not connected to the bar 49 yieldably pivots about the bar 49. The snap lock portion 41 includes a tapered recess extending from a position adjacent the bar 49 inwardly toward the flange 37 and an abrupt recess spaced inwardly of the tapered recess. As the snap lock portion 41 is guided inwardly until the abrupt recess meets the protrusion 39, the snap lock portion 41 snaps inwardly so as to fasten the connector 17 to the mounting member or support member 33.

Figure 1:
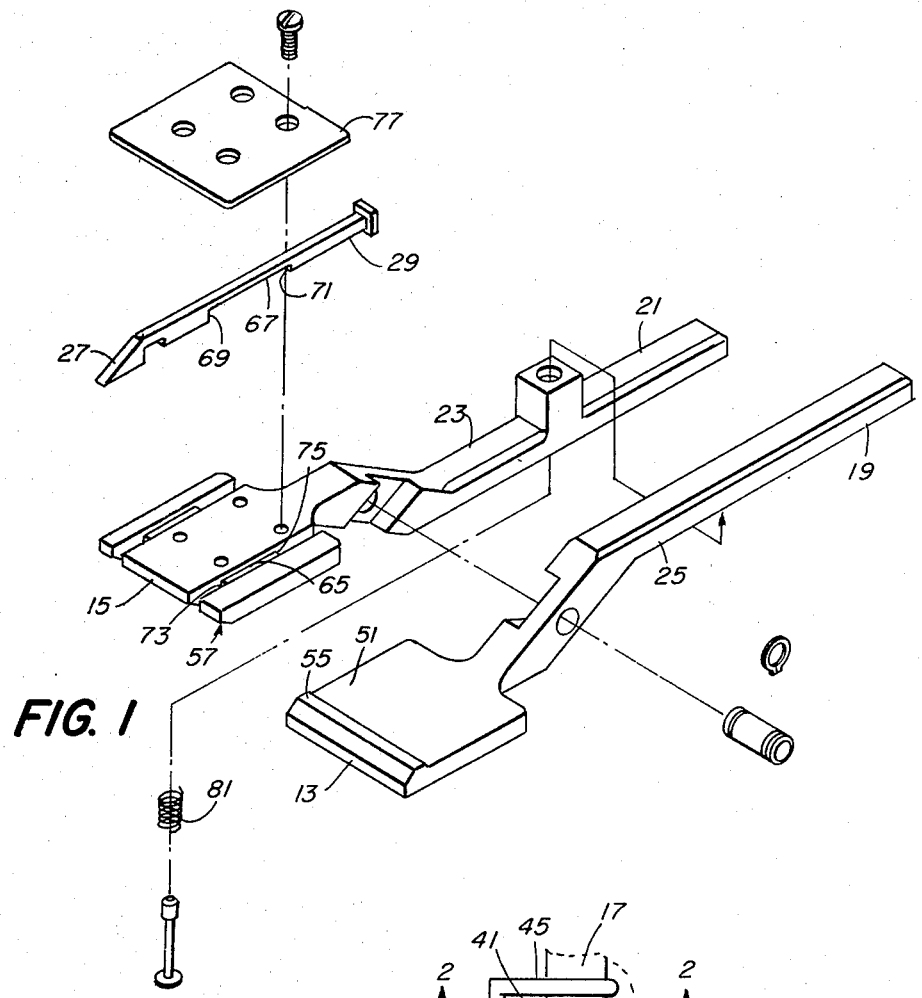
FIG. 1 is an assembly drawing showing the component parts of the extractor tool.

As illustrated in detail in FIG. 1, the extractor tool 11 comprises a pair of gripping members 13, 15 mounted for movement toward and away from one another for engaging and clamping the connector 17 therebetween. Each of the gripping members 13, 15 have opposed and facing surfaces 51, 53 with longitudinal ribs 55, 57 for engaging mating ribs 59, 61 on the connector 17. The mating ribs 59, 61 serve to align the extractor tool 11 in the proper direction so that the latch engaging member 29 properly engages the latch 31 when actuated.

The latch engaging member 29 is of generally elongated shape and is mounted for movement in a direction substantially normal to the direction of movement of the gripping members 13, 15. The latch engaging member 29 has a wedge-shaped end 27 facing the latch 31. When the gripping members 13, 15 are in proper engagement with the connector 17, the latch engaging member 29 is moved toward the latch 31 so that the wedge-shaped end 27 thereon engages the snap lock portion 41. More specifically, the wedge-shaped end 63 is forced between the snap lock portion 41 and the mounting member 33 so as to pivot snap lock portion 41 about the bar 49 and urge the snap lock portion 41 away from the mounting member 33 and release the connector 17 therefrom.

The latch engaging member 29 is mounted for movement in a groove 65 in the gripping member 15. Movement of the latch engaging member 29 toward and away from the latch 31 is limited by notched portion 67 having abutting surfaces 69, 71 which engage end surfaces 73, 75 of the groove 65. A cover plate 77 holds the latch engaging member 29 in place while permitting slidable movement.

As illustrated in detail in FIG. 2, the connector gripping members 13, 15 are an integral part of respective arms 23, 25 which are pivotably mounted at an intermediate section. On one side of pivotable mounting 79, the arms 23, 25 form handle portions 19, 21 which are adapted for hand actuation by squeezing together. The handle portions 19, 21 are normally biased apart by a resilient member 81 in the form of a spring positioned therebetween.

In operation, the connector gripping members 13, 15 are placed on either side of the connector 17 to be removed and properly positioned. Next, the handle portions 19, 21 are firmly squeezed together and the latch engaging member 29 is urged into engagement with the snap lock portion 41 to release the connector from the mounting member 33. With the connector still firmly held by the extractor tool 11, the latch engaging member 29 is withdrawn from its lock engaging position so that the connector may be fastened to another mounting member.

INDUSTRIAL APPLICABILITY

The extractor tool of the present invention is useful for quickly and efficiently removing a connector fastened to a mounting member so that the desired mechanical and electrical interconnection can be achieved while permitting rapid connect and disconnect.

We claim:

1. An extractor tool for removing a connector of the type having a latch for releasably fastening the connector to a support member, said tool comprising first and second connector gripping members mounted for movement toward and away from one another in a given direction, means for normally biasing said connector gripping members in the open position, hand actuated means operably associated with said connector gripping members for moving said members to a clamping position against the force of said biasing means, a latch engaging member mounted on at least one of said gripping members for movement in a direction substantially normal to the given direction, said latch engaging member having a wedge shaped end for engaging and releasing said connector from said support member when said gripping members are in a clamping position and said latch engaging member is moved toward said latch.

2. An extractor tool according to claim 1 wherein said hand actuated means comprises a pair of arms, a pivotable joint mounting said arms together at an intermediate position, said arms on one side of said pivotable joint moveable toward each other by hand actuation against the force of said biasing means, each of said connector gripping members being integral with a respective arm on the other side of said joint for movement toward each other when said arms are hand actuated.

3. An extractor tool according to claim 1 wherein one of said gripping members includes a groove, said latch engaging member being mounted in said groove.

* * * * *